US007513279B2

(12) United States Patent
Bernhard et al.

(10) Patent No.: US 7,513,279 B2
(45) Date of Patent: Apr. 7, 2009

(54) ROTARY BEVERAGE FILLING MACHINE FOR FILLING CANS WITH A LIQUID BEVERAGE

(75) Inventors: Herbert Bernhard, Wolfsheim (DE); Timo Jacob, Framersheim (DE)

(73) Assignee: KHS Maschinen- und Anlagenbau AG, Dortmund (DE)

( * ) Notice: Subject to any disclaimer, the term of this patent is extended or adjusted under 35 U.S.C. 154(b) by 160 days.

(21) Appl. No.: 11/462,564

(22) Filed: Aug. 4, 2006

(65) Prior Publication Data

US 2007/0029002 A1 Feb. 8, 2007

(30) Foreign Application Priority Data

Aug. 6, 2005 (DE) ..... 10 2005 037 127

(51) Int. Cl.
*B65B 3/04* (2006.01)
*B65B 43/50* (2006.01)
*B67C 3/02* (2006.01)

(52) U.S. Cl. ..... 141/90; 141/91; 141/147

(58) Field of Classification Search ..... 141/89–91, 141/144–147, 154; 222/148–149
See application file for complete search history.

(56) References Cited

U.S. PATENT DOCUMENTS

| | | | | |
|---|---|---|---|---|
| 4,024,896 | A * | 5/1977 | Ishioka et al. | 141/90 |
| 5,040,354 | A * | 8/1991 | Ahlers et al. | 53/167 |
| 6,267,157 | B1 * | 7/2001 | Gruson et al. | 141/90 |
| 7,011,117 | B1 * | 3/2006 | Carpino et al. | 141/89 |
| 7,104,033 | B2 * | 9/2006 | Krulitsch | 141/91 |
| 7,261,131 | B2 * | 8/2007 | Cleveland et al. | 141/192 |

FOREIGN PATENT DOCUMENTS

| | | |
|---|---|---|
| DE | 8705631.3 | 9/1988 |
| DE | 9403832.5 | 5/1995 |
| JP | 8295395 | 11/1996 |
| JP | 9175597 | 7/1997 |
| JP | 9309593 | 12/1997 |

* cited by examiner

*Primary Examiner*—Timothy L Maust
*Assistant Examiner*—Nicolas A Arnett
(74) *Attorney, Agent, or Firm*—Nils H. Ljungman & Associates

(57) ABSTRACT

A rotary beverage filling machine for filling cans with a liquid beverage. The rotary beverage filling machine comprises rinsing cap structures for closing the dispensing openings of the filling elements to permit cleaning of the filling elements.

17 Claims, 7 Drawing Sheets

ROTARY BEVERAGE FILLING MACHINE FOR FILLING CANS WITH A LIQUID BEVERAGE

BACKGROUND

1. Technical Field

This application relates to a beverage filling machine for filling cans with a liquid beverage. This application further relates to a filling element with a rinsing cap which can be moved between a radially inner, non-engaged position and a radially outer, engaged position, whereby the rinsing cap is held and guided by radially inward guides, wherein the rinsing cap is additionally received and/or held in its engaged position by at least one receptacle. Advantageous developments of at least one possible embodiment are described herein below.

2. Background Information

Filling elements, in particular those for use on rotary-type filling machines, are known in an extremely wide variety of models. It is also known that these filling elements as well as the surfaces of the filling elements that come into contact with critical areas of the containers during the filling process can be cleaned and/or rinsed in a cleaning or rinsing phase with a liquid and/or vapor medium, for example. Critical areas of the container are, among others, the interior surfaces of the container and the surface areas in the vicinity of the mouth of the container.

For the cleaning and/or rinsing of the filling elements, the conventional practice is to apply cap-like closing elements to the filling elements in the vicinity of the dispensing openings, by means of which, during the filling process, the liquid being bottled is introduced into the containers, and specifically to form closed rinsing spaces. These cap-like closing elements are called "rinsing caps" below.

The cleaning and/or rinsing of the filling elements, in particular of their ducts and their surface areas that come in contact with critical areas of the containers during the filling process, whereby the surfaces in question can also be sealing surfaces, can then be performed by, among other things, the rinsing and/or cleaning medium that is made to flow through the individual closed rinsing space, and which flows into the rinsing space, for example, via the respective dispensing opening of the liquid channel, and is removed via at least one additional duct that emerges in the rinsing space, for example via the back-gas duct.

The placement and fixing in position of the rinsing caps in preparation for the rinsing or cleaning phase as well as the removal of these rinsing caps after the rinsing and cleaning phase is a complex, expensive and time-consuming process.

Because the handling of the rinsing caps is particularly time-consuming and expensive when the related activities must be performed manually, numerous suggestions have been made in the past to automate these activities.

In this context, it is worth nothing that bottles that are made of glass can be manufactured in almost any desired diameter ratios between the largest diameter of the bottle and the diameter of the mouth of the bottle. On the other hand, in the manufacture of cans, which are generally made of sheet metal, there are only small ratios between the largest and the smallest diameter of the can.

Consequently, the filling positions of can-filling machines can be at a smaller distance from one another than the filling positions of bottle-filling machines, because bottle-filling machines must also be capable of filling molded bottles that are not cylindrical but can have a bulge, for example.

For cost-reduction reasons, the filling positions of can filling machines are therefore located very close together, which causes problems in the arrangement of automatically movable rinsing caps.

A device for the automatic movement of rinsing caps is described in Japanese Patent No. 9-309593 A, for example. On this device, two rinsing caps each are held on a carrier element, whereby the carrier element is held on a sled that is oriented radially in relation to the rotating carousel of the filling machine. This sled can in turn be displaced radially from a first, inner position into a second, outer position, as a result of which the rinsing caps are brought into a functional connection with the associated filling valves. The guides and thus also the points of the application of force on the sled are located between the associated filling valves on a radially inner position.

This geometric configuration of two rinsing caps on a carrier element results in a significant disadvantage of the device described in Japanese Patent No. 9-309593A, but also in all additional corresponding devices in which the rinsing caps are moved from a radially inner position into a radially outer position.

The cans to be filled by can-filling machines have diameters between 53 and 82 mm, for example. The filling valves and thus also the associated rinsing caps have corresponding diameters. The cleaning or rinsing of the filling valves takes place at pressures of up to $3\times10^5$ Pa.

On the basis of these parameters, there is a force of up to 1500 N per rinsing cap, which in connection with the disadvantageous location of the points of the application of force can result in an elastic deformation of the rinsing cap fastening.

In practice, it is frequently observed that the seals of the rinsing caps sometimes lose some or all of their sealing function as a result of these plastic deformations, as a result of which the rinsing or cleaning fluid, which is under high pressure, escapes and contaminates the filling valve and/or the filling machine.

This escape of rinsing or cleaning fluid is generally considered a disadvantage.

The prior art also describes a device as claimed in German Patent No. 940 38 32. In this device, the vertically movable bell that creates the actual sealed connection between the can and the filling valve is located inside a surrounding tube. Attached to this tube which surrounds the sealing bell are elements that hold the rinsing cap, whereby these receptacle elements are located on the circular arc of the filling valves.

Of course, this device overcomes the disadvantage of the unfavorable location of the points of the application of force, although the location of the receptacle elements on the circular arc of the midpoints of the filling valves is particularly disadvantageous, because the individual filling elements must, under some conditions, be located at an increased distance from one another. A device of this type is also mechanically complex and expensive.

OBJECT

An object of at least one possible embodiment is therefore to indicate a filling element equipped with a rinsing cap that essentially eliminates or minimizes the above disadvantages and is held in the sealed position so that leaks can be reliably prevented.

SUMMARY

To accomplish this object, at least one possible embodiment teaches a filling element for use on rotary-type filling machines for filling cans or similar containers, with a rinsing cap which can be moved between a radially inner, non-engaged position and a radially outer, engaged position, whereby the rinsing cap is held and guided by radially inward guides, wherein the rinsing cap is additionally received and/or held in its engaged position by at least one receptacle. On the filling element according to at least one possible embodiment, the rinsing cap, which is located or held in a receptacle, for the formation of the individual closed rinsing space is moved from a first, radially inner non-engaged position into a second, radially outer engaged position, whereby the rinsing cap is fixed in position by an additional holding element to maintain the seal seat.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

DESCRIPTION OF EMBODIMENT OR EMBODIMENTS

Developments, advantages and potential applications of the invention will become apparent on the basis of the following description of the exemplary embodiments and of the accompanying drawing. All the characteristics described and/or illustrated are the object of the invention, individually or in any possible combination, regardless of their placement in the claims or the references between claims. The text of the claims is simultaneously incorporated by reference into the description.

Figure 1:
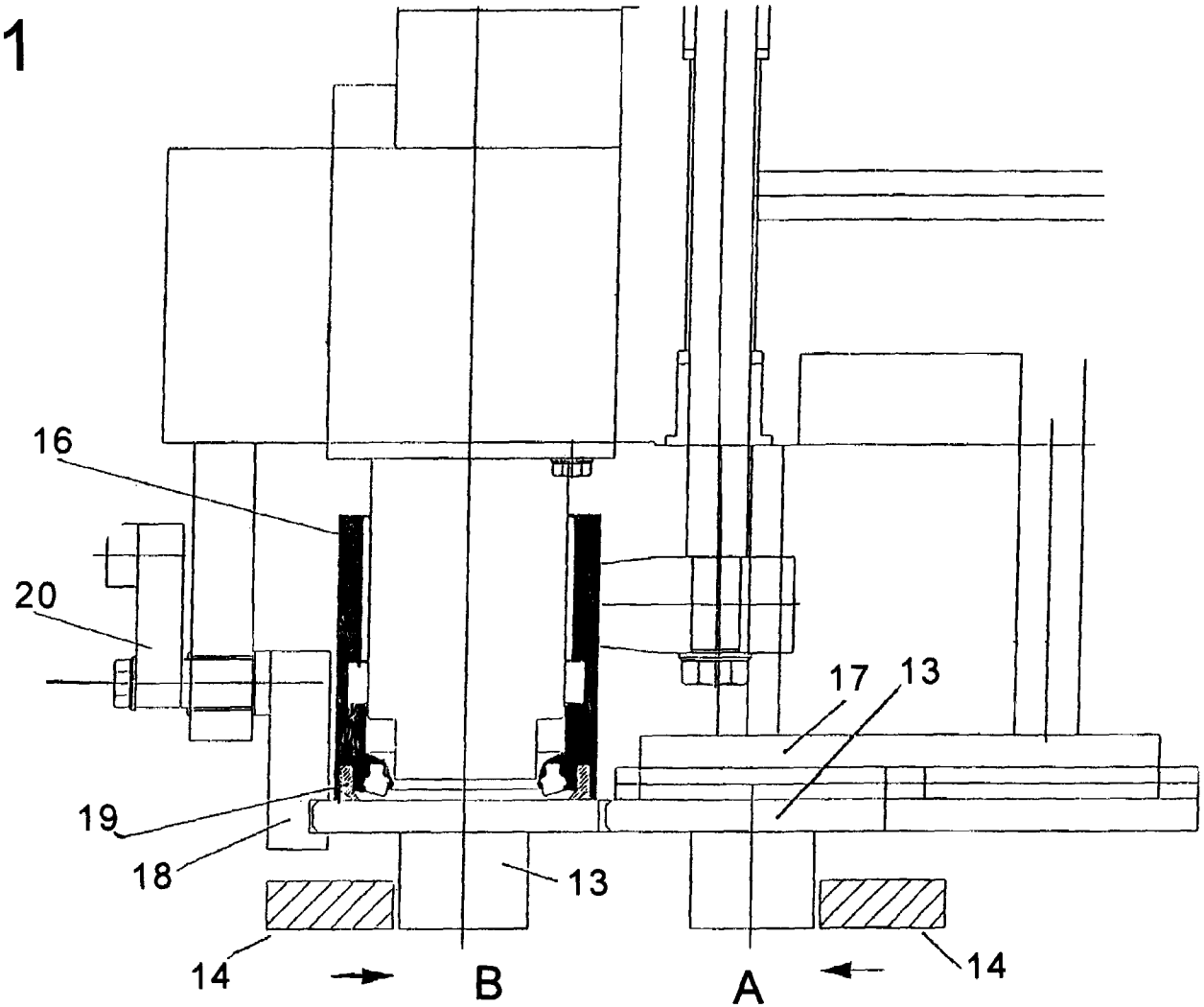
FIG. 1 is a simplified sectional drawing of a filling valve according to at least one possible embodiment.
Figure 1A:
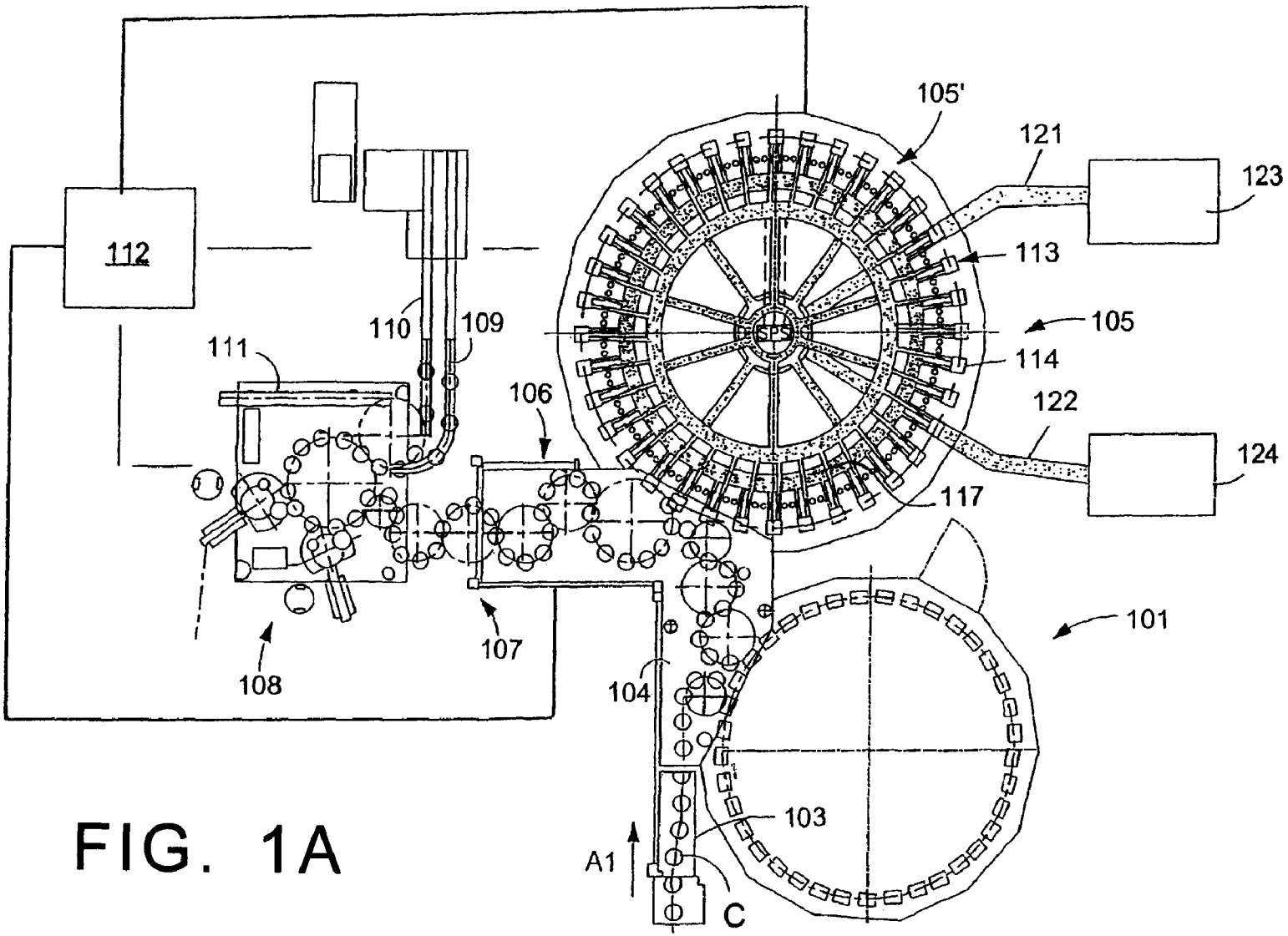
FIG. 1A shows a beverage can filling plant according to at least one possible embodiment.

FIG. 1A shows schematically the main components of one possible embodiment example of a system for filling containers, specifically, a beverage can filling plant for filling cans C with at least one liquid beverage, in accordance with at least one possible embodiment, in which system or plant could possibly be utilized at least one aspect, or several aspects, of the embodiments disclosed herein.

FIG. 1A shows a rinsing arrangement or rinsing station 101, to which the containers, namely cans C, are fed in the direction of travel as indicated by the arrow A1, by a first conveyer arrangement 103, which can be a linear conveyor or a combination of a linear conveyor and a starwheel. Downstream of the rinsing arrangement or rinsing station 101, in the direction of travel as indicated by the arrow A1, the rinsed cans C are transported to a beverage filling machine 105 by a second conveyer arrangement 104 that is formed, for example, by one or more starwheels that introduce cans C into the beverage filling machine 105.

The beverage filling machine 105 shown is of a revolving or rotary design, with a rotor 105', which revolves around a central, vertical machine axis. The rotor 105' is designed to receive and hold the cans C for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the cans C to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 1A, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each cans C, the first product or the second product can be filled by means of an appropriate control of the filling product or fluid valves.

Downstream of the beverage filling machine 105, in the direction of travel of the cans C, there can be a beverage can closing arrangement or closing station 106 which closes the cans C. The beverage can closing arrangement or closing station 106 can be connected by a third conveyer arrangement 107 to a beverage can labeling arrangement or labeling station 108. The third conveyor arrangement may be formed, for example, by a plurality of starwheels, or may also include a linear conveyor device.

In the illustrated embodiment, the beverage can labeling arrangement or labeling station 108 has at least one labeling unit, device, or module, for applying labels to cans C. In the embodiment shown, the labeling arrangement 108 has three output conveyer arrangement: a first output conveyer arrangement 109, a second output conveyer arrangement 110, and a third output conveyer arrangement 111, all of which convey filled, closed, and labeled cans to different locations.

The first output conveyer arrangement 109, in the embodiment shown, is designed to convey cans C that are filled with a first type of liquid beverage supplied by, for example, the supply reservoir 123. The second output conveyer arrangement 110, in the embodiment shown, is designed to convey cans C that are filled with a second type of liquid beverage supplied by, for example, the supply reservoir 124. The third output conveyer arrangement 111, in the embodiment shown, is designed to convey incorrectly labeled cans C. To further explain, the labeling arrangement 108 can comprise at least one beverage can inspection or monitoring device that inspects or monitors the location of labels on the cans C to determine if the labels have been correctly placed or aligned on the cans C. The third output conveyer arrangement 111 removes any cans C which have been incorrectly labeled as determined by the inspecting device. In other possible embodiments, cans may not require the addition of any information or cans may not require labeling, or cans may have the required information added or may be labeled prior to entering the rinsing arrangement or rinsing station 101, and therefore the labeling station 108 and the third output conveyer arrangement 111 may possibly be omitted.

The beverage can filling plant can be controlled by a central control arrangement 112, which could be, for example, computerized control system that monitors and controls the operation of the various stations and mechanisms of the beverage can filling plant.

As illustrated in FIG. 1, the rinsing cap 13 can be moved from a first, radially inner, non-engaged position A into a second, radially outer, engaged position B. The movement from one position to the other can be controlled in a known manner by means of a curved track control system 14, for example.

On account of the very close-together arrangement of the filling elements on can-filling machines, only a few millimeters of space remain between the individual bells 16 that create the sealed connection with the cans 15.

Accordingly, in a manner that is in itself known, the invention provides guides 17 for the rinsing caps 13 not on the circular arc of the midpoints of the filling valves and thus between the individual bells 16, but in a radially inner position.

According to at least one possible embodiment, to retain the sealed position during the rinsing process, the rinsing cap 13 in its radially outer, engaged position B is held in at least one additional element, for example a receptacle 18.

For this purpose, the rinsing cap 13 is preferably held with its forward end in the at least one receptacle 18, whereby it is particularly advantageous if the at least one receptacle 18 is located radially outside the circular arc of the filling valves with reference to the axis of rotation of the can-filling machine.

Figure 1B:
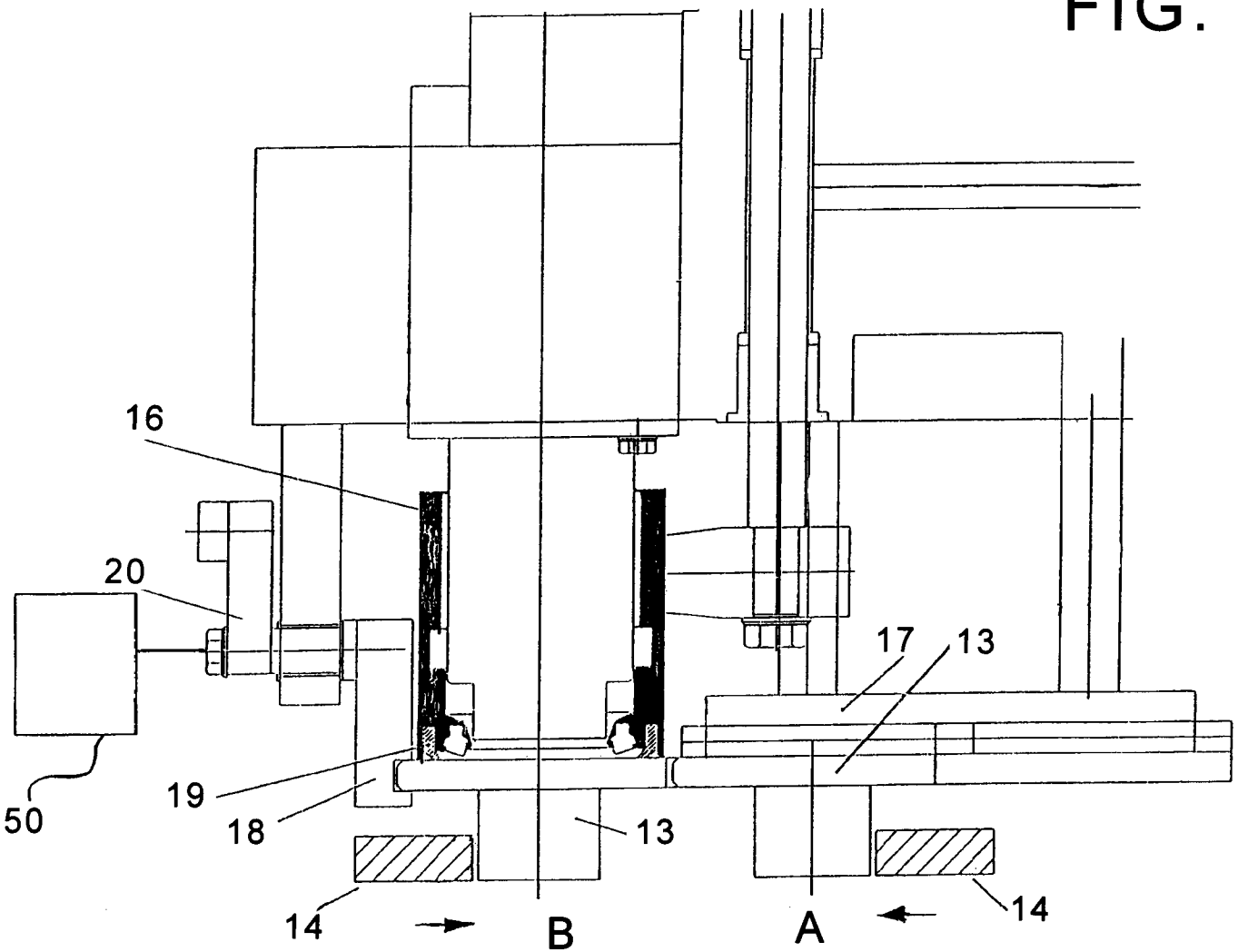
FIG. 1B shows a drive mechanism according to at least one possible embodiment.
Figure 1C:
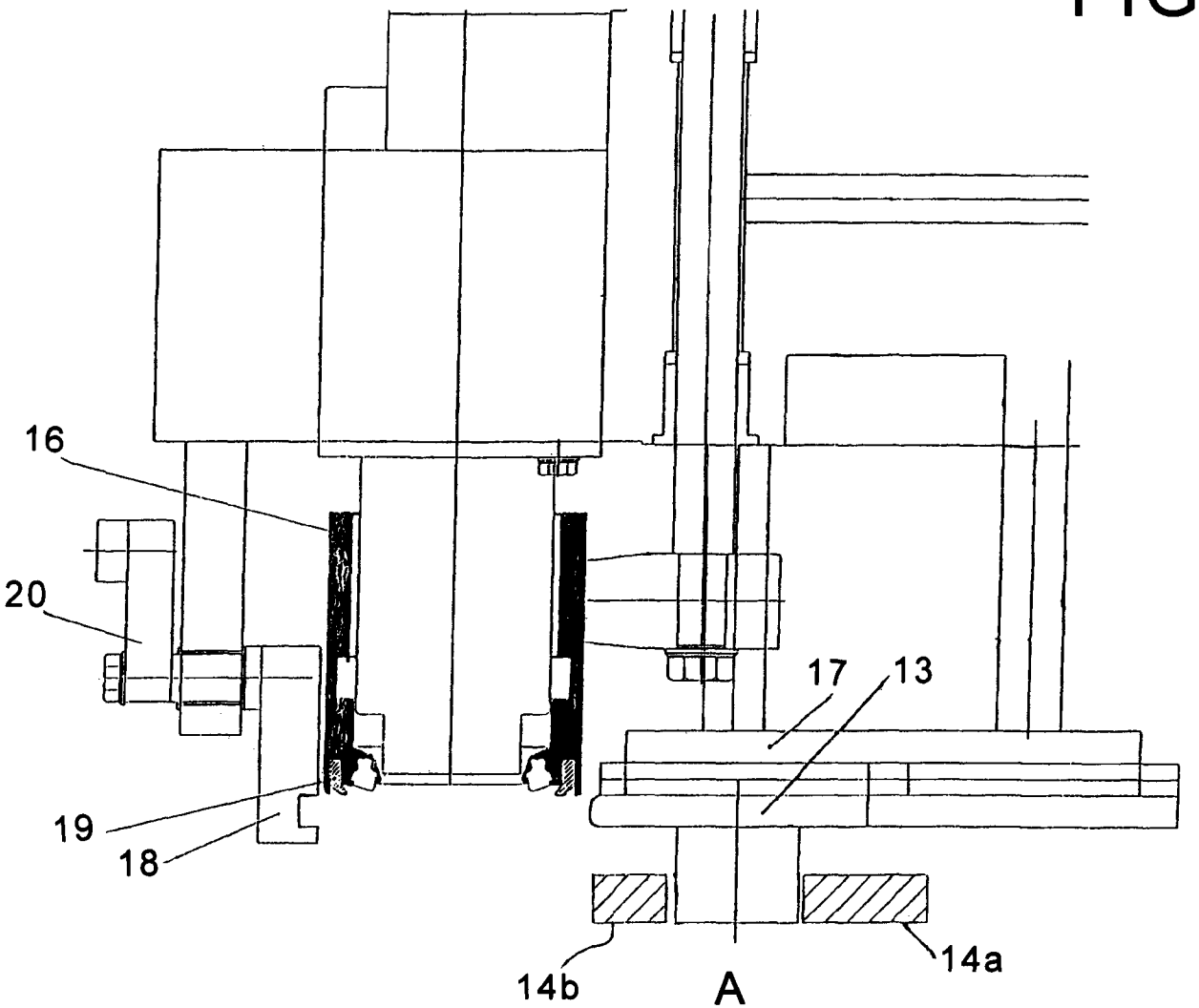
FIG. 1C is a cross-sectional view of a rinsing cap that is in the radially inner non-engaged position.
Figure 1D:
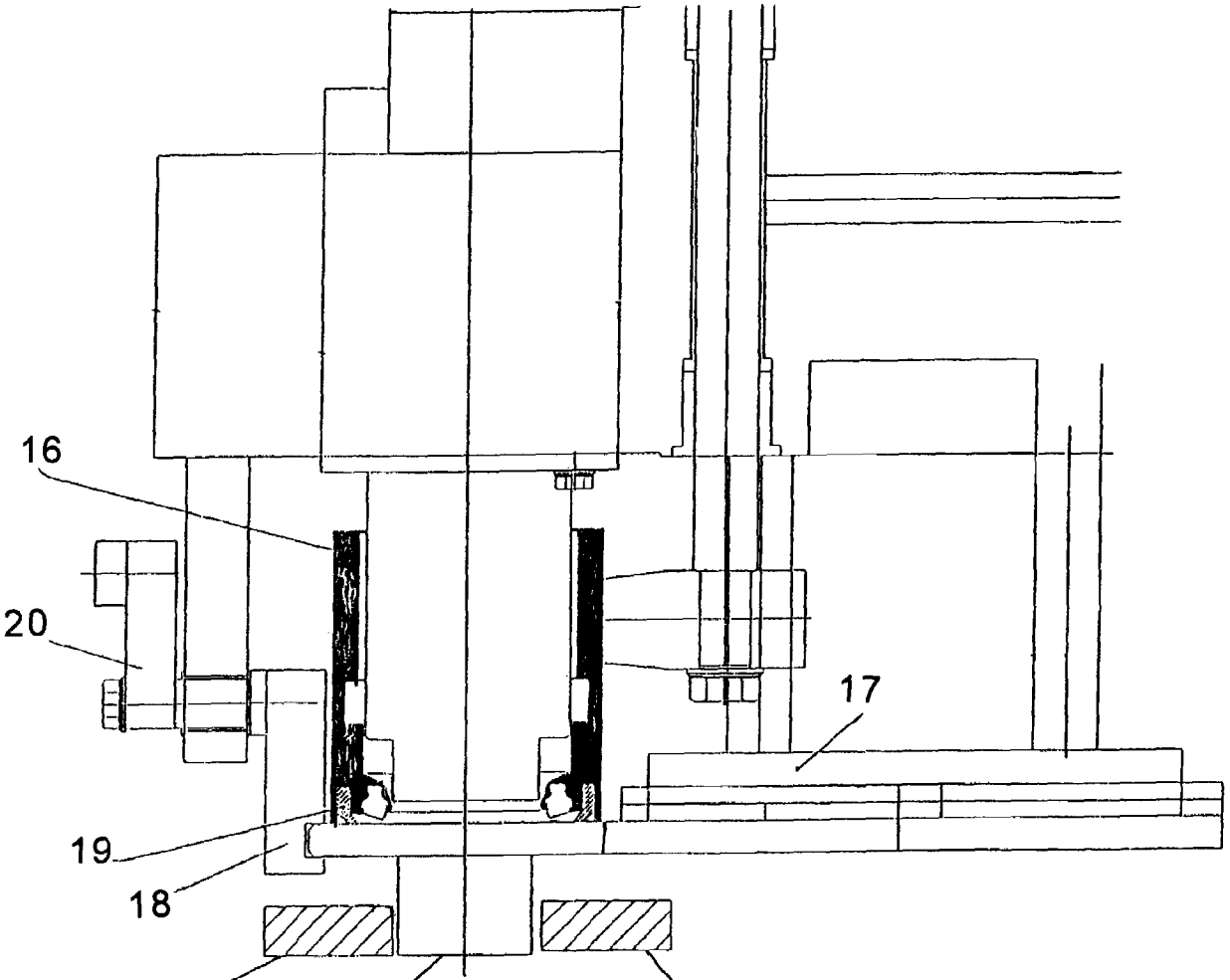
FIG. 1D is a cross-sectional view of a rinsing cap that is in the radially outer engaged position.
Figure 2:
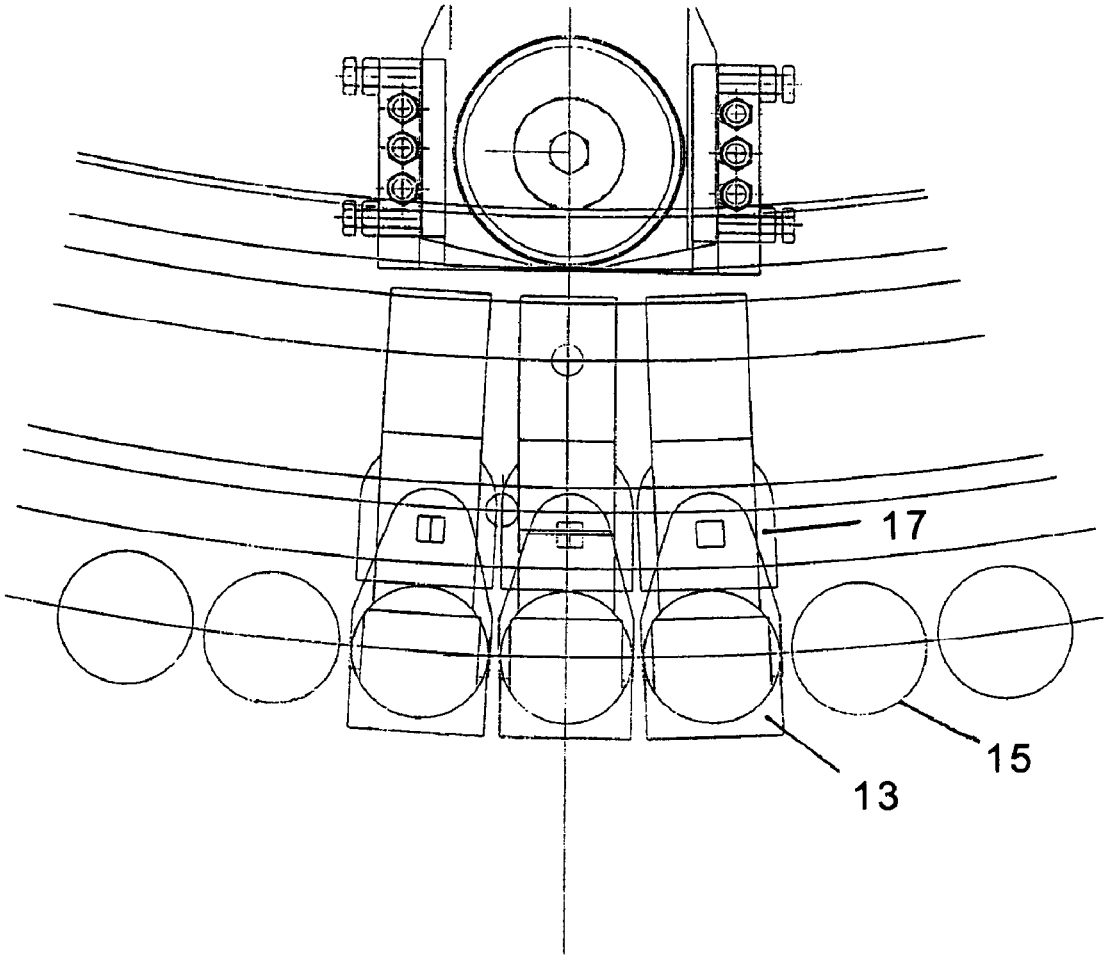
FIG. 2 is an overhead view of portions of the circular arc of a can filling machine based on the rotary principle.

The forward end of the rinsing cap 13, as can be seen in FIG. 2, is positioned further away in a radial direction from the center of the rotor than all other portions of the rinsing cap 13 The receptacle 18 serves as an end support structure which supports the forward end of the rinsing cap 13 when the rinsing cap 13 is extended radially, such as shown in FIG. 1D. The end support structure 18 is positioned a distance from the radial guide structure 17, which distance, as can be seen in FIGS. 1 through 1D, may be greater than or equal to the diameter of the dispensing opening. The end support structure 18 has a slot therein for receiving solely the forward end of the rinsing cap 13, which is shown in FIGS. 1 through 1D. The slot is elongated so as to receive and support the forward end of the rinsing cap 13 across the width of the rinsing cap 13, which width can be seen in FIG. 2.

So that the rinsing cap 13 is provided with additional support by the receptacle 18 during the rinsing process, the force conditions of the overall arrangement are fundamentally improved, so that the elastic deformations that were experienced on machines of the prior art are eliminated, which guarantees a secure preservation of the seal between the O-ring 19 that is located inside the bell 16 and the rinsing cap 13.

Because the forward receptacles 18 of the rinsing caps 13 circulate with the carousel of the can-filling machine, it can occur with certain geometric dimensions of the components that the receptacles project into the path of the cans 15 in the carousel of the filling machine, in particular in the vicinity of the can inlet and outlet.

To substantially eliminate or minimize problems of this type, in one particularly advantageous development, the receptacles 18 are realized so that they can be placed in a position between a non-engaged position and an engaged position.

For example, the receptacles 18 can be realized so that they can pivot around a horizontal axis, so that the receptacles 18, after the completion of the rinsing process, can be pivoted into the non-engaged position, and thereby not interfere with the entry and exit of the cans.

The pivoting movements of the receptacles 18 are preferably controlled by means of a cam or curved-track mechanism in which, for example, a pivoting lever 20 transmits the movements specified by the curved track to the receptacle 18.

However, the pivoting movement of the receptacles 18 can also be effected in a different manner, e.g. by means of open-loop or closed-loop controlled stepper motors, servomotors or synchronous motors. FIG. 1B shows a drive mechanism 50 used to control the pivoting movement of the receptacles 18, and according to at least one possible embodiment may comprise an open-loop or closed-loop controlled stepper motor, servomotor or synchronous motor.

In an additional configuration, the components of the filler valve are realized so that the receptacle 18 does not interfere with the entry or exit of the cans in spite of the fact that the receptacle 18 is immovable.

FIG. 1C shows the rinsing cap 13 in a radially inner, non-engaged position A, and FIG. 1D shows the rinsing cap 13 in a radially outer, engaged position B. The movement from one position to the other can be controlled in a known manner by means of a curved track control system 14, for example.

FIG. 2 shows the guides 17 for the rinsing caps 13 in a radially inner position according to at least one possible embodiment.

Figure 4:
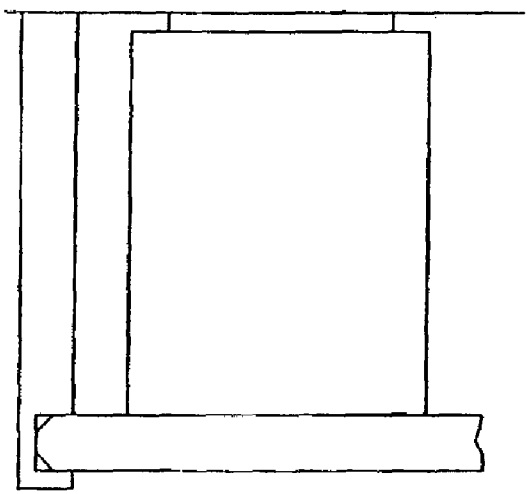
FIGS. 3 and 4 show an additional exemplary embodiment of the invention.
Figure 3:
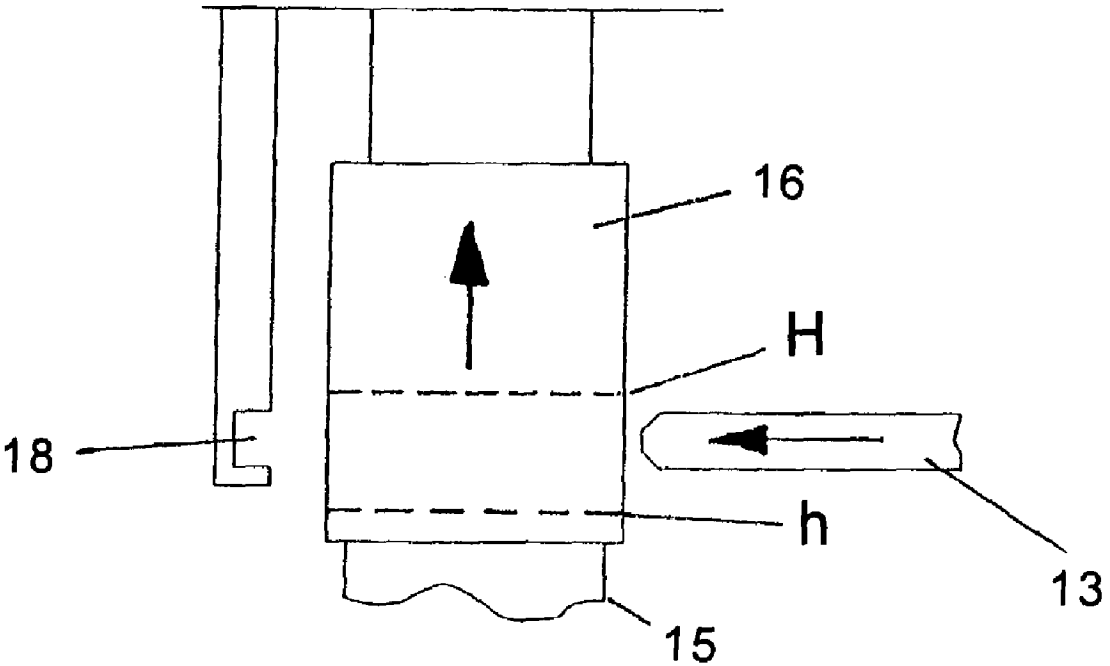

As illustrated in FIGS. 3 and 4, for this purpose the invention teaches that the bell 16 is realized so that it can execute an expanded reciprocating movement.

During the normal filling of the cans 15, the bell 16 executes only a normal reciprocating movement h, which is sufficient to seal the cans 15 and release them again. To rinse and/or clean the filling element, the bell 16 executes a large reciprocating movement H which clears the path of the rinsing cap 13 so that the rinsing cap can enter into a functional connection with the receptacle 18.

One feature or aspect of an embodiment is believed at the time of the filing of this patent application to possibly reside broadly in a rotary beverage filling machine for filling cans with a liquid beverage material, said beverage filling machine comprising: a rotor; a rotatable vertical machine column; said rotor being connected to said vertical machine column to permit rotation of said rotor about said vertical machine column; a plurality of beverage filling elements for filling cans with liquid beverage material being disposed at the periphery of said rotor; each of said plurality of beverage filling elements being configured and disposed to dispense liquid beverage material into cans to be filled; at least one liquid reservoir being configured to hold a supply of liquid beverage material; at least one supply line arrangement being configured and disposed to connect said at least one liquid reservoir to said beverage filling elements to supply liquid beverage material to said beverage filling elements; a first star wheel structure being configured and disposed to move cans into said beverage filling machine; a second star wheel structure being configured and disposed to move filled cans out of said beverage filling machine; and each of said plurality of beverage filling elements comprising: a can carrier being configured and disposed to receive and hold cans to be filled; a dispensing device being configured and disposed to control dispensation of liquid beverage material into cans; said dispensing device comprising a dispensing opening being configured and disposed to be brought into sealing engagement with a can prior to filling of the can with liquid beverage material, and to be disengaged from the can upon completion of filling of the can with liquid beverage material; a rinsing cap structure being configured and disposed to cover said dispensing opening during a cleaning of said beverage filling machine; said rinsing cap structure being configured to be radially moved, with respect to the center of said rotor, between a first position and a second position, said first position being radially closer to the center of said rotor than said second position; said first position being a position where said rinsing cap structure is disposed a distance away from said dispensing opening; said second position being a position where said rinsing cap structure is disposed immediately adjacent said dispensing opening; a drive mechanism being configured and disposed to move said rinsing cap structure; said rinsing cap structure being configured to be moved radially from said first position to said second position and brought into sealing engagement with said dispensing opening to close said dispensing opening during cleaning of said beverage filling machine and said filling elements; said rinsing cap structure being configured to be disengaged from said dispensing opening upon completion of cleaning of said beverage filling machine and said filling elements and moved radially back to said first position; a radial guide structure being configured and disposed to guide said rinsing cap structure upon radial movement thereof; and a receptacle slot structure being configured and disposed to support said rinsing cap structure, upon said rinsing cap structure being in said second position and engaged with said dispensing opening, to compensate for forces exerted on said rinsing cap structure during cleaning of said beverage filling machine and said filling elements to minimize deformation of said rinsing cap structure; said receptacle slot structures are disposed further away in a radial direction from the center of said rotor than said dispensing devices of said beverage filling elements are disposed; and each of said receptacle slot structures comprises: a first lateral side section and a second lateral side section disposed opposite said first lateral side section; an end section disposed substantially transverse to and to connect said first and second lateral side sections; at least one of: said end section; and said first and second lateral side sections is configured to receive and support said rinsing cap structure.

Still another feature or aspect of an embodiment is believed at the time of the filing of this patent application to possibly reside broadly in the rotary beverage filling machine, wherein: each of said receptacle slot structures is configured to be moved between a first, engaged position and a second, disengaged position; said first, engaged position is the position where said receptacle slot structure is disposed to receive and support a corresponding rinsing cap structure in a cleaning process; and said second, disengaged position is the position where said receptacle slot structure is disposed away from said first position in a filling process.

A further feature or aspect of an embodiment is believed at the time of the filing of this patent application to possibly reside broadly in the rotary beverage filling machine, wherein the movement of each of said receptacle slot structures is controlled by a cam or curved track mechanism.

Another feature or aspect of an embodiment is believed at the time of the filing of this patent application to possibly reside broadly in the rotary beverage filling machine, wherein: said dispensing device is configured and disposed to move vertically up and down; and said dispensing device is configured to move upwardly to a position where the dispensing opening is located a distance above and away from the path of movement of the rinsing cap structure.

Yet another feature or aspect of an embodiment is believed at the time of the filing of this patent application to possibly reside broadly in a rotary beverage filling machine for filling cans with a liquid beverage material, said beverage filling machine comprising: a rotor; a plurality of beverage filling elements for filling cans with liquid beverage material being disposed at the periphery of said rotor; each of said plurality of beverage filling elements being configured and disposed to dispense liquid beverage material into cans to be filled; at least one liquid reservoir being configured to hold a supply of liquid beverage material; at least one supply line arrangement being configured and disposed to connect said at least one liquid reservoir to said beverage filling elements to supply liquid beverage material to said beverage filling elements; each of said plurality of beverage filling elements comprising: a can carrier being configured and disposed to receive and hold cans to be filled; a dispensing device being configured and disposed to control dispensation of liquid beverage material into cans; said dispensing device comprising a dispensing opening from which liquid beverage material is dispensed into cans; a rinsing cap structure being configured and disposed to cover said dispensing opening during a cleaning of said beverage filling machine; said rinsing cap structure being configured to be radially moved, with respect to the center of said rotor, between a first position and a second position, said first position being radially closer to the center of said rotor than said second position; said first position being a position where said rinsing cap structure is disposed a distance away from said dispensing opening; said second position being a position where said rinsing cap structure is disposed immediately adjacent said dispensing opening; a drive mechanism being configured and disposed to move said rinsing cap structure; said rinsing cap structure being configured to be moved radially from said first position to said second position and brought into sealing engagement with said dispensing opening to close said dispensing opening during cleaning of said beverage filling machine and said filling elements; said rinsing cap structure being configured to be disengaged from said dispensing opening upon completion of cleaning of said beverage filling machine and said filling elements and moved radially back to said first position; a radial guide structure being configured and disposed to guide said rinsing cap structure upon radial movement thereof; and a receptacle slot structure being configured and disposed to support said rinsing cap structure, upon said rinsing cap structure being in said second position and engaged with said dispensing opening, to compensate for forces exerted on said rinsing cap structure during cleaning of said beverage filling machine and said filling elements to minimize deformation of said rinsing cap structure.

Still another feature or aspect of an embodiment is believed at the time of the filing of this patent application to possibly reside broadly in the rotary beverage filling machine, wherein said receptacle slot structures are disposed further away in a radial direction from the center of said rotor than said dispensing devices of said beverage filling elements are disposed.

A further feature or aspect of an embodiment is believed at the time of the filing of this patent application to possibly reside broadly in the rotary beverage filling machine, wherein each of said receptacle slot structures comprises: a first lateral side section and a second lateral side section disposed opposite said first lateral side section; an end section disposed substantially transverse to and to connect said first and second lateral side sections; at least one of: said end section; and said first and second lateral side sections is configured to receive and support said rinsing cap structure.

Another feature or aspect of an embodiment is believed at the time of the filing of this patent application to possibly reside broadly in the rotary beverage filling machine, wherein: each of said receptacle slot structures is configured to be moved between a first, engaged position and a second, disengaged position; said first, engaged position is the position where said receptacle slot structure is disposed to receive and support a corresponding rinsing cap structure in a cleaning process; and said second, disengaged position is the position where said receptacle slot structure is disposed away from said first position in a filling process.

Yet another feature or aspect of an embodiment is believed at the time of the filing of this patent application to possibly reside broadly in the rotary beverage filling machine, wherein the movement of each of said receptacle slot structures is controlled by a cam or curved track mechanism.

Still another feature or aspect of an embodiment is believed at the time of the filing of this patent application to possibly reside broadly in the rotary beverage filling machine, wherein: said dispensing device is configured and disposed to move vertically up and down; and said dispensing device is configured to move upwardly to a position where the dispensing opening is located a distance above and away from the path of movement of the rinsing cap structure.

Another feature or aspect of an embodiment is believed at the time of the filing of this patent application to possibly reside broadly in a filling element for use on rotary-type filling machines for filling cans or similar containers, with a rinsing cap which can be moved between a radially inner, non-engaged position and a radially outer, engaged position, whereby the rinsing cap is held and guided by radially inward guides, wherein the rinsing cap is additionally received and/or held in its engaged position by at least one receptacle.

Yet another feature or aspect of an embodiment is believed at the time of the filing of this patent application to possibly reside broadly in the filling element, wherein the at least one receptacle is located radially outside the circular arc of the midpoints of the filler valves with reference to the axis of rotation of the can filling machine.

Still another feature or aspect of an embodiment is believed at the time of the filing of this patent application to possibly reside broadly in the filling element, wherein the at least one receptacle receives the rinsing cap on its radially outward end surface and/or its radially outward lateral surfaces.

A further feature or aspect of an embodiment is believed at the time of the filing of this patent application to possibly reside broadly in the filling element, wherein the at least one receptacle can be brought into a non-engaged position and into an engaged position.

Another feature or aspect of an embodiment is believed at the time of the filing of this patent application to possibly reside broadly in the filling element, wherein the movement of the receptacle is controlled by a cam or curved track mechanism.

Yet another feature or aspect of an embodiment is believed at the time of the filing of this patent application to possibly reside broadly in the filling element, wherein the stroke of the bell is long enough that the bell can be removed from the path or the plane of movement of the rinsing cap between its non-engaged position and its engaged position.

The components disclosed in the various publications, disclosed or incorporated by reference herein, may possibly be used in possible embodiments of the present invention, as well as equivalents thereof.

Some examples of filling machines that utilize electronic control devices to control various portions of a filling or canning process and that may possibly be utilized or possibly adapted for use in at least one possible embodiment of the present application may possibly be found in the following U.S. Pat. No.: 2,761,780 to Stewart on Sep. 4, 1956; No. 4,559,961 issued to Anderson et al. on Dec. 24, 1985; No. 4,821,921 issued to Cartwright et al. on Apr. 18, 1989; No. 5,056,511 issued to Ronge on Oct. 15, 1991; No. 5,273,082 issued to Paasche et al. on Dec. 28, 1993; and No. 5,301,488 issued to Ruhl et al. on Apr. 12, 1994.

Some examples of filling machines that utilize electronic control devices to control various portions of a filling or canning process and that may possibly be utilized or possibly adapted for use in at least one possible embodiment of the present application are: the Innofill DMD and the Innofill DVD, both of which are manufactured by KHS Maschinen- und Anlagenbau Aktiengesellschaft, located at Juchostrasse 20, D-44143 Dortmund, Germany.

An example of a can rinsing machine that may possibly be utilized or possibly adapted for use in at least one possible embodiment of the present application is an Eriez can rinser, manufactured by Eriez Manufacturing Company, located at 2200 Asbury Road, P.O. Box 10608, Erie, Pa., 16514, USA.

Some examples of can seamers or can closing machines that may possibly be utilized or possibly adapted for use in at least one possible embodiment of the present application are: the Model 180S Can Seamer, the Model 140S Can Seamer, and the Model 12M Can Seamer, which are all manufactured by the Angelus Sanitary Can Machine Company, located at 4900 Pacific Boulevard, Los Angeles, Calif., 90058, USA.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

Some examples of control systems which measure operating parameters and learn therefrom that may possibly be utilized or possibly adapted for use in at least one possible embodiment of the present application may possibly be found in the following U.S. Pat. No.: 4,655,188 issued to Tomisawa et al. on Apr. 7, 1987; No. 5,191,272 issued to Torii et al. on Mar. 2, 1993; No. 5,223,820, issued to Sutterlin et al. on Jun. 29, 1993; and No. 5,770,934 issued to Theile on Jun. 23, 1998.

The appended drawings in their entirety, including all dimensions, proportions and/or shapes in at least one embodiment of the invention, are accurate and are hereby included by reference into this specification.

Some examples of open-loop control systems that may possibly be utilized or possibly adapted for use in at least one possible embodiment of the present application may possibly be found in the following U.S. Pat. No.: 5,770,934 issued to Theile on Jun. 23, 1998; No.5,210,473 issued to Backstrand on May 11, 1993; No. 5,320,186 issued to Strosser et al. on Jun. 14, 1994; and No. 5,369,342 issued to Rudzewicz et al. on Nov. 29, 1994.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Some examples of closed-loop control circuits that may possibly be utilized or possibly adapted for use in at least one possible embodiment of the present application may possibly be found in the following U.S. Pat. No.: 5,770,934 issued to Theile on Jun. 23, 1998; No. 5,189,605 issued to Zuehlke et al. on Feb. 23, 1993; No. 5,223,072 issued to Brockman et al. on Jun. 29, 1993; and No. 5,252,901, issued to inventors Ozawa et al. on. Oct. 12, 1993.

All, or substantially all, of the components and methods of the various embodiments may be used with at least one embodiment or all of the embodiments, if more than one embodiment is described herein.

Some examples of stepping motors that may possibly be utilized or possibly adapted for use in at least one possible embodiment of the present application may possibly be found in the following U.S. Pat. No.: 6,348,774 issued to Andersen et al. on Feb. 19, 2002; No. 6,373,209 issued to Gerber et al. on Apr. 16, 2002; No. 6,424,061 issued to Fukuda et al. on Jul. 23, 2002; No. 6,509,663 issued to Aoun on Jan. 21, 2003; No. 6,548,923 to Ohnishi et al. on Apr. 15, 2003; and No. 6,661, 193 issued to Tsai on Dec. 9, 2003.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

Some examples of servo-motors that may possibly be utilized or possibly adapted for use in at least one possible embodiment of the present application may possibly be found in the following U.S. Pat. No.: 4,050,434 issued to Zbikowski et al. on Sep. 27, 1977; No. 4,365,538 issued to Andoh on Dec. 28, 1982; No. 4,550,626 issued to Brouter on Nov. 5, 1985; No. 4,760,699 issued to Jacobsen et al. on Aug. 2, 1988; No. 5,076,568 issued to de Jong et al. on Dec. 31, 1991; and No. 6,025 issued to Yasui on Feb. 15, 2000.

All of the patents, patent applications and publications recited herein, and in the Declaration attached hereto, are hereby incorporated by reference as if set forth in their entirety herein.

Some examples of synchronous motors which may possibly be utilized or adapted for use in at least one possible embodiment may possibly be found in the following U.S. Pat. No.: 6,713,899, entitled "Linear synchronous motor;" No. 6,486,581, entitled "Interior permanent magnet synchronous motor;" No. 6,424,114, entitled "Synchronous motor;" No. 6,388,353, entitled "Elongated permanent magnet synchronous motor;" No. 6,329,728, entitled "Cylinder-type linear synchronous motor;" No. 6,025,659, entitled "Synchronous motor with movable part having permanent magnets;" No. 5,936,322, entitled "Permanent magnet type synchronous motor;" and No. 5,448,123, entitled "Electric synchronous motor."

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

Some examples of rotation sensors that may possibly be utilized or possibly adapted for use in at least one possible embodiment of the present application may possibly be found in the following U.S. Pat. No.: 6,246,232 issued to Okamura on Jun. 12, 2001; No. 6,448,761 issued to Stumpe on Sep. 10, 2002; No. 6,474,162 to Voss et al. on Nov. 5, 2002; No. 6,498,481 issued to Apel on Dec. 24, 2002; No. 6,532,831 issued to Jin et al. on Mar. 18, 2003; and No. 6,672,175 issued to Jin et al. on Jan. 6, 2004.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

Some examples of filling machines that utilize electronic control devices to control various portions of a filling or bottling process and that may possibly be utilized or possibly adapted for use in at least one possible embodiment of the present application may possibly be found in the following U.S. Pat. No.: 4,821,921 issued to Cartwright et al. on Apr. 18, 1989; No. 5,056,511 issued to Ronge on Oct. 15, 1991; No. 5,273,082 issued to Paasche et al. on Dec. 28, 1993; and No. 5,301,488 issued to Ruhl et al. on Apr. 12, 1994.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

Some examples of position sensors or position sensor systems that may be used or adapted for use in at least one possible embodiment of the present invention may be found in the following U.S. Pat. No.: 5,794,355, issued to inventor Nickum on Aug. 18, 1998; No. 5,520,290, issued to inventors Kumar et al. on May 28, 1996; No. 5,074,053, issued to inventor West on Dec. 24, 1991; and No. 4,087,012, issued to inventor Fogg on May 2, 1978.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

All of the patents, patent applications or patent publications, which were cited in the German Office Action, and/or cited elsewhere are hereby incorporated by reference as if set forth in their entirety herein as follows: JP9-309593A, JP8-295395A, JP9-175597A, and DE8705631U1.

The corresponding foreign patent publication application, namely, Federal Republic of Germany Patent Application No. 10 2005 037 127.2, filed on Aug. 6, 2005, having inventors Herbert BERNHARD and Timo JACOB is hereby incorporated by reference as if set forth in its entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

What is claimed is:

1. A rotary beverage filling machine for filling cans with a liquid beverage material, said beverage filling machine comprising:

a rotor;

a rotatable vertical machine column;

said rotor being connected to said vertical machine column to permit rotation of said rotor about said vertical machine column;

a plurality of beverage filling elements for filling cans with liquid beverage material being disposed at the periphery of said rotor;

each of said plurality of beverage filling elements being configured and disposed to dispense liquid beverage material into cans to be filled;

at least one liquid reservoir being configured to hold a supply of liquid beverage material;

at least one supply line arrangement being configured and disposed to connect said at least one liquid reservoir to said beverage filling elements to supply liquid beverage material to said beverage filling elements;

a first star wheel structure being configured and disposed to move cans into said beverage filling machine;

a second star wheel structure being configured and disposed to move filled cans out of said beverage filling machine; and each of said plurality of beverage filling elements comprising:

a can carrier being configured and disposed to receive and hold cans to be filled;

a dispensing device being configured and disposed to control dispensation of liquid beverage material into cans;

said dispensing device comprising a dispensing opening being configured and disposed to be brought into sealing engagement with a can prior to filling of the can with liquid beverage material, and to be disengaged from the can upon completion of filling of the can with liquid beverage material;

a rinsing cap structure being configured and disposed to cover said dispensing opening during a cleaning of said beverage filling machine;

said rinsing cap structure being configured to be radially moved, with respect to the center of said rotor, between a first position and a second position, said first position being radially closer to the center of said rotor than said second position;

said first position being a position where said rinsing cap structure is disposed a distance away from said dispensing opening;

said second position being a position where said rinsing cap structure is disposed immediately adjacent said dispensing opening;

a drive mechanism being configured and disposed to move said rinsing cap structure;

said rinsing cap structure being configured to be moved radially from said first position to said second position and brought into sealing engagement with said dispensing opening to close said dispensing opening during cleaning of said beverage filling machine and said filling elements;

said rinsing cap structure being configured to be disengaged from said dispensing opening upon completion of cleaning of said beverage filling machine and said filling elements and moved radially back to said first position;

said rinsing cap structure comprising a forward end being disposed further in a radical direction from the center of said rotor than all other portions of said rinsing cap structure;

a radial guide structure being configured and disposed to guide said rinsing cap structure upon radial movement thereof;

said radial guide structure being disposed closer in a radial direction to the center of said rotor than said dispensing device;

an end support structure being configured and disposed to support said rinsing cap structure, upon said rinsing cap structure being in said second position and engaged with said dispensing opening, to compensate for forces exerted on said rinsing cap structure during cleaning of said beverage filling machine and said filling elements to minimize deformation of said rinsing cap structure;

said end support structure being disposed further away in a radial direction from the center of said rotor than said dispensing device;

said end support structure being disposed a distance from said radial guide structure, which distance is greater than or equal to the diameter of said dispensing opening; and said end support structure comprising an elongated slot being configured to receive solely said forward end of said rinsing cap structure.

2. The rotary beverage filling machine according to claim 1, wherein:

each of said end support structures is configured to be moved between a first, engaged position and a second, disengaged position;

said first, engaged position is the position where said end support structure is disposed to receive and support a corresponding rinsing cap structure in a cleaning process; and said second, disengaged position is the position where said end support structure is disposed away from said first position in a filling process.

3. The rotary beverage filling machine according to claim 2, wherein said rotary beverage filling machine comprises a cam or curved track mechanism configured and disposed to engage with said end support structures to control the movement thereof.

4. The rotary beverage filling machine according to claim 3, wherein:

said dispensing device is configured and disposed to move vertically up and down; and said dispensing device is configured to move upwardly to a position where the dispensing opening is located a distance above and away from the path of movement of the rinsing cap structure.

5. The rotary beverage filling machine according to claim 4 wherein:

each of said end support structures comprises a pivoting arrangement configured to permit pivoting of said end support structure between said first, engaged position and said second, disengaged position;

said rotary filling machine comprises a curved track disposed below said rinsing cap structures;

each of said rinsing cap structures comprises a vertical projecting portion disposed to project downwardly into said curved track; and said projecting portion is configured and disposed to engage said curved track to control the movement of said rinsing cap between said first position and said second position.

6. A rotary beverage filling machine for filling cans with a liquid beverage material, said beverage filling machine comprising:

a rotor;

a plurality of beverage filling elements for filling cans with liquid beverage material being disposed at the periphery of said rotor;

each of said plurality of beverage filling elements being configured and disposed to dispense liquid beverage material into cans to be filled;

at least one liquid reservoir being configured to hold a supply of liquid beverage material;

at least one supply line arrangement being configured and disposed to connect said at least one liquid reservoir to said beverage filling elements to supply liquid beverage material to said beverage filling elements;

each of said plurality of beverage filling elements comprising:

a can carrier being configured and disposed to receive and hold cans to be filled;

a dispensing device being configured and disposed to control dispensation of liquid beverage material into cans;

said dispensing device comprising a dispensing opening from which liquid beverage material is dispensed into cans;

a rinsing cap structure being configured and disposed to cover said dispensing opening during a cleaning of said beverage filling machine;

said rinsing cap structure being configured to be radially moved, with respect to the center of said rotor, between a first position and a second position, said first position being radially closer to the center of said rotor than said second position;

said first position being a position where said rinsing cap structure is disposed a distance away from said dispensing opening;

said second position being a position where said rinsing cap structure is disposed immediately adjacent said dispensing opening;

a drive mechanism being configured and disposed to move said rinsing cap structure;

said rinsing cap structure being configured to be moved radially from said first position to said second position and brought into sealing engagement with said dispensing opening to close said dispensing opening during cleaning of said beverage filling machine and said filling elements;

said rinsing cap structure being configured to be disengaged from said dispensing opening upon completion of cleaning of said beverage filling machine and said filling elements and moved radially back to said first position;

said rinsing cap structure comprising an end portion being disposed further away in a radial direction from the center of said rotor than other portions of said rinsing cap structure;

a radial guide structure being configured and disposed to guide said rinsing cap structure upon radial movement thereof;

said radial guide structure being disposed closer in a radial direction to the center of said rotor than said dispensing device;

an end support structure being configured and disposed to support said rinsing cap structure, upon said rinsing cap structure being in said second position and engaged with said dispensing opening, to compensate for forces exerted on said rinsing cap structure during cleaning of said beverage filling machine and said filling elements to minimize deformation of said rinsing cap structure;

said end support structure being disposed further away in a radial direction from the center of said rotor than said dispensing device;

said end support structure being disposed a distance from said radial guide structure, which distance is greater than or equal to the diameter of said dispensing opening; and said end support structure comprising an elongated slot being configured to receive solely said end portion of said rinsing cap structure.

7. The rotary beverage filling machine according to claim 6, wherein:

each of said end support structures is configured to be moved between a first, engaged position and a second, disengaged position;

said first, engaged position is the position where said end support structure is disposed to receive and support a corresponding rinsing cap structure in a cleaning process; and said second, disengaged position is the position where said end support structure is disposed away from said first position in a filling process.

8. The rotary beverage filling machine according to claim 7, wherein said rotary beverage filling machine comprises a cam or curved track mechanism configured and disposed to engage with said end support structures to control the movement thereof.

9. The rotary beverage filling machine according to claim 8, wherein:

said dispensing device is configured and disposed to move vertically up and down; and said dispensing device is configured to move upwardly to a position where the dispensing opening is located a distance above and away from the path of movement of the rinsing cap structure.

10. The rotary beverage filling machine according to claim 9, wherein each of said end support structures comprises a pivoting arrangement configured to permit pivoting of said end support structure between said first, engaged position and said second, disengaged position.

11. The rotary filling machine according to claim 10, wherein:

said rotary filling machine comprises a curved track disposed below said rinsing cap structures;

each of said rinsing cap structures comprises a vertical projecting portion disposed to project downwardly into said curved track; and said projecting portion is configured and disposed to engage said curved track to control the movement of said rinsing cap between said first position and said second position.

12. A rotary filling machine for filling cans with a liquid filling material, said filling machine comprising:

a rotor;

a plurality of filling elements for filling cans with liquid filling material being disposed at the periphery of said rotor;

each of said plurality of filling elements being configured and disposed to dispense liquid filling material into cans to be filled;

at least one liquid reservoir being configured to hold a supply of liquid filling material;

at least one supply line arrangement being configured and disposed to connect said at least one liquid reservoir to said filling elements to supply liquid filling material to said filling elements;

each of said plurality of filling elements comprising:

a can carrier being configured and disposed to receive and hold cans to be filled;

a dispensing device being configured and disposed to control dispensation of liquid filling material into cans;

said dispensing device comprising a dispensing opening from which liquid filling material is dispensed into cans;

a rinsing cap structure being configured and disposed to cover said dispensing opening during a cleaning of said filling machine;

said rinsing cap structure being configured to be radially moved, with respect to the center of said rotor, between a first position and a second position, said first position being radially closer to the center of said rotor than said second position;

said first position being a position where said rinsing cap structure is disposed a distance away from said dispensing opening;

said second position being a position where said rinsing cap structure is disposed immediately adjacent said dispensing opening;

said rinsing cap structure being configured to be moved radially from said first position to said second position and brought into sealing engagement with said dispensing opening to close said dispensing opening during cleaning of said filling machine and said filling elements;

said rinsing cap structure being configured to be disengaged from said dispensing opening upon completion of cleaning of said filling machine and said filling elements and moved radially back to said first position;

said rinsing cap structure comprising an end portion being disposed further away in a radial direction from the center of said rotor than other portions of said rinsing cap structure;

a radial guide structure being configured and disposed to guide said rinsing cap structure upon radial movement thereof;

said radial guide structure being disposed closer in a radial direction to the center of said rotor than said dispensing device;

an end support structure being configured and disposed to support said rinsing cap structure, upon said rinsing cap structure being in said second position and engaged with said dispensing opening, to compensate for forces exerted on said rinsing cap structure during cleaning of said filling machine and said filling elements to minimize deformation of said rinsing cap structure;

said end support structure being disposed further away in a radial direction from the center of said rotor than said dispensing device;

said end support structure being disposed a distance from said radial guide structure, which distance is greater than or equal to the diameter of said dispensing opening; and said end support structure comprising an elongated slot being configured to receive said end portion of said rinsing cap structure.

13. The rotary filling machine according to claim 12, wherein:

said rotary filling machine comprises a curved track disposed below said rinsing cap structures;

each of said rinsing cap structures comprises a vertical projecting portion disposed to project downwardly into said curved track; and said projecting portion is configured and disposed to engage said curved track to control the movement of said rinsing cap between said first position and said second position.

14. The rotary filling machine according to claim 13, wherein:

each of said end support structures is configured to be moved between a first, engaged position and a second, disengaged position;

said first, engaged position is the position where said end support structure is disposed to receive and support a corresponding rinsing cap structure in a cleaning process; and said second, disengaged position is the position where said end support structure is disposed away from said first position in a filling process.

15. The rotary filling machine according to claim 14, wherein each of said end support structures comprises a pivoting arrangement configured to permit pivoting of said end support structure between said first, engaged position and said second, disengaged position.

16. The rotary filling machine according to claim 15, wherein said rotary filling machine comprises a cam or curved track mechanism configured and disposed to engage with said pivoting arrangement of said end support structures to control the pivoting movement thereof.

17. The rotary filling machine according to claim 16, wherein:

said dispensing device is configured and disposed to move vertically up and down; and said dispensing device is configured to move upwardly to a position where the dispensing opening is located a distance above and away from the path of movement of the rinsing cap structure.

* * * * *